US007230533B2

(12) United States Patent
Hamolsky

(10) Patent No.: US 7,230,533 B2
(45) Date of Patent: Jun. 12, 2007

(54) NEVERLOST KEYCHAIN

(76) Inventor: Sharon Lee Hamolsky, 103 Matamoros Ct., Solana Beach, CA (US) 92075

( * ) Notice: Subject to any disclaimer, the term of this patent is extended or adjusted under 35 U.S.C. 154(b) by 0 days.

(21) Appl. No.: 11/161,572

(22) Filed: Aug. 8, 2005

(65) Prior Publication Data

US 2007/0030147 A1 Feb. 8, 2007

(51) Int. Cl.
*G08B 1/08* (2006.01)

(52) U.S. Cl. ..... 340/539.32; 340/825.36

(58) Field of Classification Search ..... 340/539.32
See application file for complete search history.

(56) References Cited

U.S. PATENT DOCUMENTS 4,507,653 A * 3/1985 Bayer ..... 340/539.32
5,673,023 A * 9/1997 Smith ..... 340/571
5,796,334 A * 8/1998 Chen et al. ..... 340/539.3
6,166,652 A * 12/2000 Benvenuti ..... 340/825.49
6,297,737 B1 * 10/2001 Irvin ..... 340/571
6,366,202 B1 * 4/2002 Rosenthal ..... 340/539.32
6,535,125 B2 * 3/2003 Trivett ..... 340/539.13
6,674,364 B1 * 1/2004 Holbrook et al. ..... 340/568.1
6,759,958 B2 * 7/2004 Hall ..... 340/568.1
6,870,483 B1 * 3/2005 Davis ..... 340/691.1
2003/0231550 A1 * 12/2003 Macfarlane ..... 367/198

* cited by examiner

*Primary Examiner*—Daniel Wu
*Assistant Examiner*—George A. Bugg
(74) *Attorney, Agent, or Firm*—Biotechnology Law Group

(57) ABSTRACT

Devices for locating misplaced keys are described. Such devices include a housing in which is disposed a cell phone receiver, a ringer, associated circuitry, a power supply, and an "on/off" switch". Such devices may also include a battery life indicator disposed in the housing, which indicator is visible to a user.

2 Claims, 1 Drawing Sheet

NEVERLOST KEYCHAIN

FIELD OF THE INVENTION

This invention relates to electronic devices, particularly to electronic devices useful for locating misplaced keys.

BACKGROUND OF THE INVENTION

This invention provides a solution for the problem of misplaced keys and keychains.

SUMMARY OF THE INVENTION

The invention concerns keychain locators. Such locators include a housing that houses the device electronics, a ringer to produce ringing sounds, and battery-based power supply. The device also includes an "on/off" switch accessible through the housing, and in some embodiments, an indicator showing battery life. The electronics include a cell phone receiver and associated circuitry. The cell phone receiver has a cell phone number assigned to it. When the cell phone receiver receives an interrogation including its associated phone number, the electronics actuate the ringer to produce a ringing sound to enable the user to locate the keychain.

DETAILED DESCRIPTION OF THE INVENTION

Figure 1:
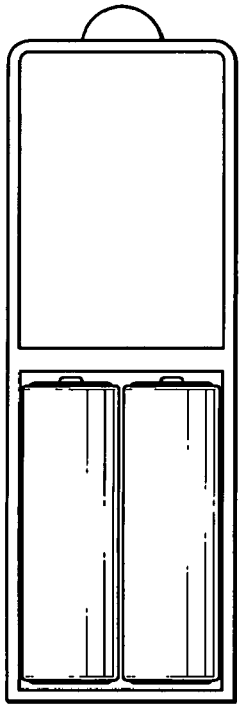
FIG. 1 is an illustration showing an internal view of a device according to the invention.
Figure 2:
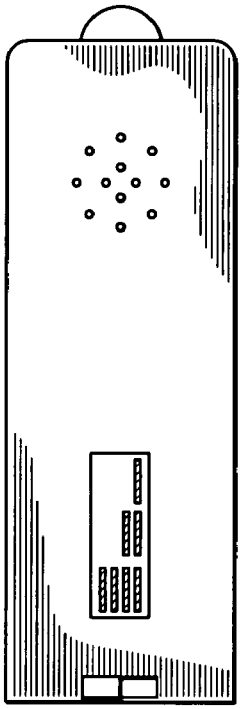
FIG. 2 is an illustration showing an external view of a device according to the invention.

A keychain (1) which houses a cell phone receiver (2) and ringer (3). The keychain will have a phone number associated with it. If you misplace the keychain, you will call the number, the keychain will ring and you will be able to locate it. It will be battery powered (4) with an indicator (5) to show battery life. It has an "on/off" switch (6) by which a user can turn the device "on" and "off".

What is claimed is:

1. A keychain locator, consisting of:

a cell phone receiver programmed to receive an incoming telephone interrogation on an associated telephone number and actuate a ringer to produce a sound upon receipt of a telephone interrogation to the associated telephone number;

a ringer for producing a ringing sound upon receipt of a telephone interrogation to the associated telephone number; to locate the keychain locator;

a power supply connected to the cell phone receiver and ringer;

a housing for housing the cell phone receiver, a ringer, and a power supply; and an "on/off" switch to turn the device "on" and "off".

2. A keychain locator, consisting of:

a cell phone receiver programmed to receive an incoming telephone interrogation on an associated telephone number and actuate a ringer to produce a sound upon receipt of a telephone interrogation to the associated telephone number;

a ringer for producing a ringing sound upon receipt of a telephone interrogation to the associated telephone number; to locate the keychain locator;

a power supply connected to the cell phone receiver and ringer;

a housing for housing the cell phone receiver, ringer, and power supply, and a battery life indicator visible to a user; and an "on/off" switch to turn the device "on" and "off".

* * * * *